US007443102B2

(12) United States Patent
Yin et al.

(10) Patent No.: US 7,443,102 B2
(45) Date of Patent: Oct. 28, 2008

(54) ENERGY-CONSERVING DEVICES OF ILLUMINATION SYSTEMS

(75) Inventors: Tao Yin, Jiangsu (CN); Xiping Zhang, Jiangsu (CN); Minggao He, Jiangsu (CN)

(73) Assignee: Jiangsu Tianxi Lighting and Vision Engineering Company Ltd., Jiangsu (CN)

( * ) Notice: Subject to any disclaimer, the term of this patent is extended or adjusted under 35 U.S.C. 154(b) by 168 days.

(21) Appl. No.: 11/645,485

(22) Filed: Dec. 26, 2006

(65) Prior Publication Data

US 2008/0079370 A1 Apr. 3, 2008

Related U.S. Application Data

(63) Continuation of application No. PCT/CN2006/002549, filed on Sep. 29, 2006.

(51) Int. Cl.
*H05B 41/00* (2006.01)

(52) U.S. Cl. ..... 315/193; 315/275; 340/539.3

(58) Field of Classification Search ..... 713/1, 713/300, 320, 312, 322, 323, 324, 500; 91/416, 91/459, 461; 99/330, 331, 403, 468, 470; 455/127.1, 127.5, 343.1, 343.2, 343.3, 343.4, 455/574; 315/159, 224, 241 P, 97, DIG. 4; 340/539.1, 7.35, 7.38, 7.43, 825.69, 855.5
See application file for complete search history.

(56) References Cited

U.S. PATENT DOCUMENTS 4,339,690 A 7/1982 Regan et al.
4,549,116 A 10/1985 Andrews
6,404,140 B1 * 6/2002 Nerone ..... 315/209 R

FOREIGN PATENT DOCUMENTS

CN 2123157 U 11/1992
CN 2722407 Y 8/2005
JP 11149989 A 6/1999

OTHER PUBLICATIONS

Related PCT Application Serial No. PCT/CN2006/002549, International Search Report, mailed Jun. 28, 2007.

* cited by examiner

*Primary Examiner*—Tuyet Vo
*Assistant Examiner*—Jae K Kim
(74) *Attorney, Agent, or Firm*—Lathrop & Gage LC

(57) ABSTRACT

Disclosed is an energy-conserving device for an illumination system. The energy-conserving device is connected between a power supply of and a lighting assembly of the illumination system. The energy-conserving assembly provides a first switch, a ballast, and a compensating capacitor. The ballast is connected between the power supply and the lighting assembly, and connected between the first terminal and the second terminal of the first switch. The compensating capacitor is connected between the power supply and a third terminal of the switch. The energy-conserving device may further include a resistor and a second switch which are connected in parallel with the ballast. The energy-conserving device can be coupled to a conventional illumination system and is of energy-conserving, a low cost and a long lifetime.

10 Claims, 5 Drawing Sheets

ENERGY-CONSERVING DEVICES OF ILLUMINATION SYSTEMS

CROSS REFERENCE TO RELATED APPLICATIONS

This application is a continuation of PCT Application No. PCT/CN2006/002549 filed Sep. 29, 2006, which is explicitly incorporated herein by reference in its entirety.

BACKGROUND OF THE INVENTION

1. Field of the Invention

The invention relates to an energy-conserving device of an illumination system, in particularly to an energy-conserving device employed for high intensity discharge (HID) lamps in hopes of saving energy by means of adjusting illumination intensity.

2. Description of Prior Art

HID lamps have been widely used as lighting sources due to its high efficiency and long service life, which are especially utilized in outdoor areas, such as roads, sports arena, supermarkets, etc. As show in FIG. 1, a conventional HID lamp includes a discharge light bulb 640, a trigger 630 for initiation of electrical discharge, a ballast 610 for limiting current that passes through a bulb 60, as well as a compensating capacitor 620 for power factor correction. Generally, the illumination intensity of the current HID lamps keeps the same, regardless of the required brightness of the illumination, therefore resulting in wasting large amount of energy.

To address the shortcoming, Chinese patent No. 200420081845.x discloses a power-variable inductance ballast device. As illustrated in FIG. 2 of the patent, an additional inductance ballast 720 is connected in parallel to an inductance ballast 710 via a tap. The power level is controlled through a switch 730 connecting each of ballasts 710 and 720 so as to alter the output power of an electrical discharging light bulb 740. However, this solution increases the complexity of wiring of the inner circuitry. Furthermore, when the system works at different power levels, its circuitry may not match its power factor due to the limitation of the compensation capacitor. So, it is hard to reach a desirable effect of energy conservation. In addition, when the power level is switched, the system will experience a switching period. In essence, it's a power down process, which might result in collapse of arc and interruption of illuminating. To avoid this incident, it is necessary to shrink the switching period. A high-quality controller must be used for this purpose, which results in lower cost effectiveness and raises the failure rate of the product.

SUMMARY OF THE INVENTION

The present invention is to provide an energy-conserving device which can be used to regulate the illumination intensity of an HID lamp for saving energy without changing the configuration of the existing HID lamps.

Accordingly, the present invention provides an energy-conserving device used in an illumination system. The energy-conserving device is connected between a power supply assembly of the illumination system and a lighting assembly of the illumination system. The energy-conserving device comprises an energy-conserving assembly. The energy-conserving assembly comprises: a first switch having a first terminal, a second terminal and a third terminal, the first terminal configured to be optionally connected with the second terminal or the third terminal; a ballast having two terminals respectively connected to the power supply and the lighting assembly, and the two terminals further connected to the first terminal and the second terminal of the first switch, respectively; and a compensating capacitor, one terminal of which is connected to the power supply, and the other terminal is connected to the third terminal of the switch.

According to a preferred embodiment of the present invention the energy-conserving assembly of the energy-conserving device may further include a second switch, and a resistor which is connected in parallel to the two terminals of the ballast after connected in series with the second switch.

According to a preferred embodiment of the present invention the energy-conserving device further includes a control assembly which is connected between the power supply assembly and the switch for controlling the connection or disconnection of the switch. The control assembly may comprise a power circuit and a timing circuit, where, the power circuit provides a power source to the timing circuit and the timing circuit provides switch signals to the switch.

Preferably, the power circuit of the present invention may comprise a transformer, a full wave rectifying circuit and a voltage regulating chip which are connected in series to each other. The timing circuit can be carried out by a single chip, RC circuit and so on.

The control assembly may further include a power driving circuit in accordance with an preferred embodiment of the present invention, in which the switch signals generated from the timing circuit are amplified by the power driving circuit to output to the switch for controlling the connection or disconnection of the switch.

The energy-conserving device employed in the present invention can implement light regulation and energy-conserving without changing a conventional lighting circuit. Moreover, the energy-conserving device of the present invention may choose the corresponding compensating capacitor depending on different light regulation states to correct a power factor. The energy-conserving device of the present invention can prolong the using life of the illumination system, ensure the lighting effect and have the advantages of low cost, easy assembling, high safety and reliability.

DETAILED DESCRIPTION OF THE INVENTION

The present invention will be described with reference to exemplary embodiments in conjunction with the drawings.

Figure 1:
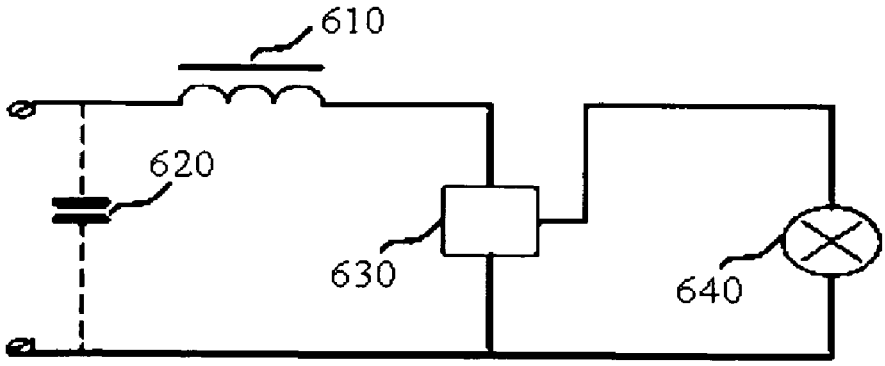
Fig. 1 (Prior Art)
FIG. 1 illustrates a circuit diagram of an illumination system in the prior art.
Figure 2:
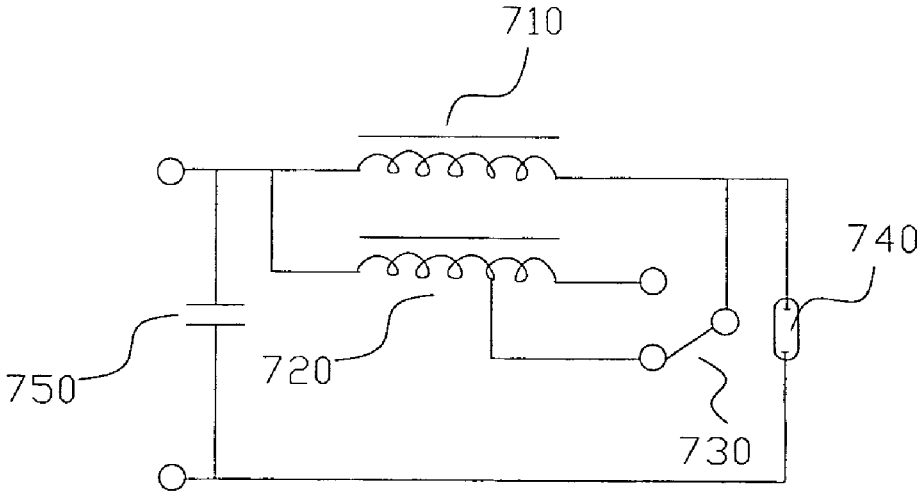
Fig. 2 (Prior Art)
FIG. 2 illustrates a circuit diagram of an illumination system with an energy conserving device in the prior art.
Figure 3A:
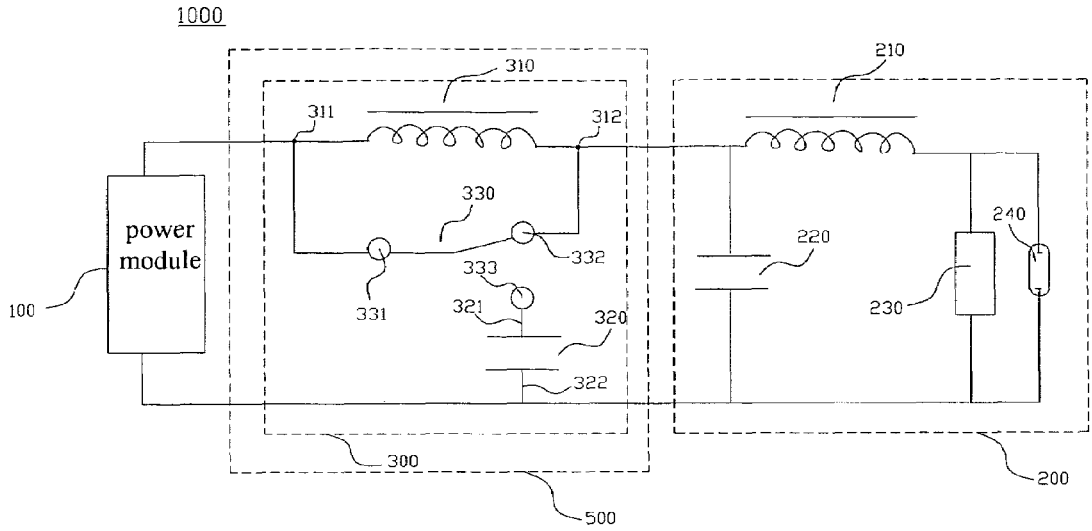
FIG. 3*a* illustrates a circuit diagram of an energy conserving device according to an embodiment according to the present invention.

An illumination system 1000 of an embodiment of the invention is illustrated in FIG. 3*a*. An energy conserving device 500 is connected between a power module 100 and an illumination module 200. The power module 100 supplies power, e.g. 380V, 220V or 110V AC, to the illumination module 200. The illumination module 200 comprises a ballast 210, a compensating capacitor 220, a trigger 230, and a lighting source 240. The compensating capacitor 220, trigger 230, and light source 240 are connected in parallel, while the ballast 210 is connected in serial between the compensating capacitor 220 and the trigger 230.

The energy conserving device 500 provides an energy conserving module 300 comprising a ballast 310, a compensating capacitor 320 and a switch 330. The ballast 310 is connected in serial between the power module 100 and the illumination module 200. Opposite terminals 311 and 312 of the ballast 310 are connected to terminals 331 and 332 of the switch 330, respectively. One terminal 322 of the compensating capacitor 320 is connected to the power module 100 and another terminal 321 is connected to a terminal 333 of the switch 330.

Normally, the terminals 331 and 332 of the switch 330 are conductive with each other, and the terminals 331 and 333 are disconnected. As of this configuration, the ballast 310 is short circuited and the capacitor 320 is open circuited. It means that the energy conserving device 500 is inactive and the illumination module 200 works at its full capacity with its normal intensity of illumination.

When a lower intensity of illumination than the normal is tolerated, the terminal 331 and the terminal 333 of the switch 330 can be connected accordingly, resulting in disconnection of the terminal 331 and the terminal 332. At this time, the capacitor 320 is charged. In this case, the ballast 310 is connected in serial to the ballast 210. The ballast 310 functions to reduce the voltage to be applied to the lighting source 240 as well as limit the current to flow through the source 240. As a result, the illumination module 200 will work in a lower-power with a lower intensity of illumination. Due to the existence of the capacitor 320, even when the power level has reduced, the illumination system 1000 can effectively correct the power factor of the circuitry so as to improve efficiency of illumination.

It's understood from FIG. 3*a* that, in the condition that the illumination system 1000 works at a normal power, the ballast 310 is short circuited due to the connection between the terminals 331 and 332 of the switch 330. When the change of the power level is needed, the ballast 310 works at the moment that the terminal 332 moves to connect the terminal 333 and disconnect the terminal 331. The movement of the switch 330 will not result in the collapse of arc. Thus, it is possible to use a switch at a trade-off between the performance and the cost.

Figure 3B:
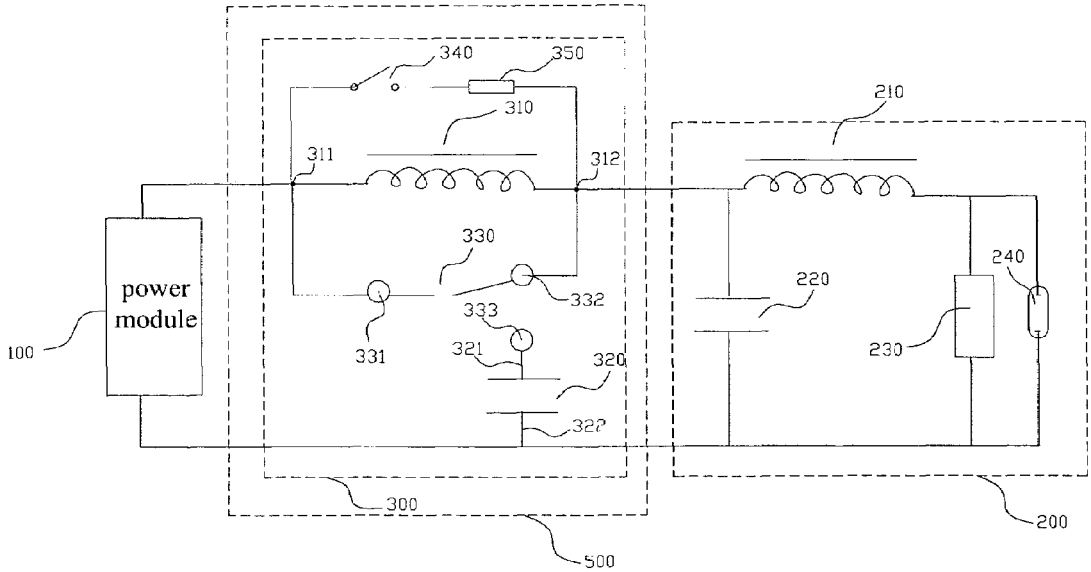
FIG. 3*b* illustrates a circuit diagram of an energy conserving device according to another embodiment.

FIG. 3*b* illustrates a circuit diagram of another embodiment of the energy conserving device according to the invention. Compared to FIG. 3*a*, a resistor 350 and a switch 340 in serial are included in the energy conserving module 300 of the energy conserving device 500. The serial-connected resistor 350 and switch 340 are further connected in parallel to the ballast 310. At the normal operation (a high illumination degree), the terminals 331 and 332 of switch 330 are connected to each other, and the switch 340 is closed (conductive). Thus, the resistor 350, like the ballast 310, is short circuited and inactive.

When a lower intensity of illumination is needed, the switch 330 will be triggered to connect the terminal 331 and the terminal 333, while the switch 340 will remain at the closed state for a short period of time, e.g. about 5 seconds. During this period, the power provide by a power module 110 is supplied through the parallel connection of the resistor 350 and ballast 310 to the illumination module 200. At the end of the period (referred to a "delay period"), the switch 340 will be open (disconnected), and the resistor 350 becomes inactive. The module 200 will work at a reduced voltage, as stated above. It is understood by those skilled in the art that, at the moment of turning the switch 330, even if the current flowing through the ballast 310 could not be adjusted so quickly that the ballast 310 suffers from an instantaneous disconnection, the illumination module 200 will be power-supplied due to the existence of the parallel circuit consisting of the resistor 350, the switch 340 and the ballast 310. In this way, collapse due to the art incident will be further overcome.

Figure 4:
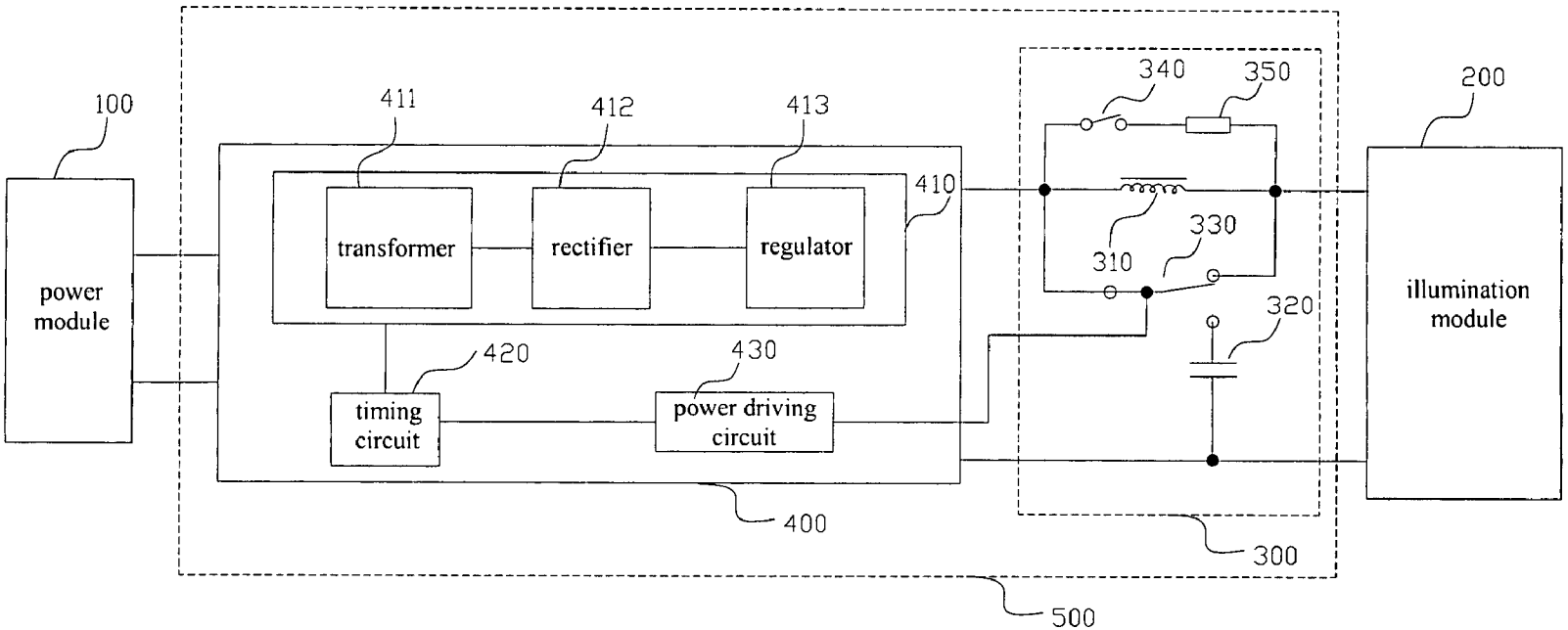
FIG. 4 illustrates a block diagram of an energy conserving device with a control module and a timer.

As illustrated in FIG. 4 which shows another embodiment of the invention, a control module 400 is further incorporated into the energy conserving device 500 so that power module 100, the control module 400 and energy conserving module 300 connects in serial. The control module 400 comprises a timing circuit 420 for signaling the switch 330 and a power circuit 410 for power-supplying to the timing circuit 420.

Preferably, the power circuit 410 is composed of a transformer 411, a full wave rectifier 412 and the chip controlled regulator 413 connected in serial.

Preferably, the timing circuit 420 is implemented by utilizing conventional means like a single chip machine or a RC circuitry.

In an embodiment of the invention, the control module 400 further comprises a power driving circuit such as a power amplifier 430. Thus, signals produced from the timing circuit 420 will be amplified via a power amplifier 430 and then outputted to the switch 330 and the switch 340 for controlling the operation thereof.

Figure 5A:
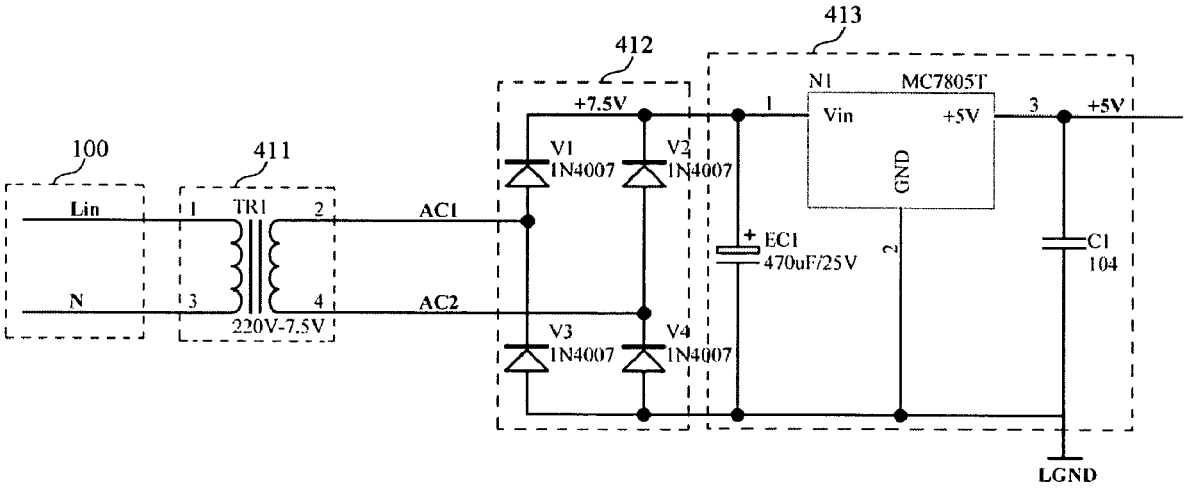
FIGS. 5*a* and 5*b* illustrate a detailed circuit diagram of the energy conserving device as shown in FIG. 4.
Figure 5B:
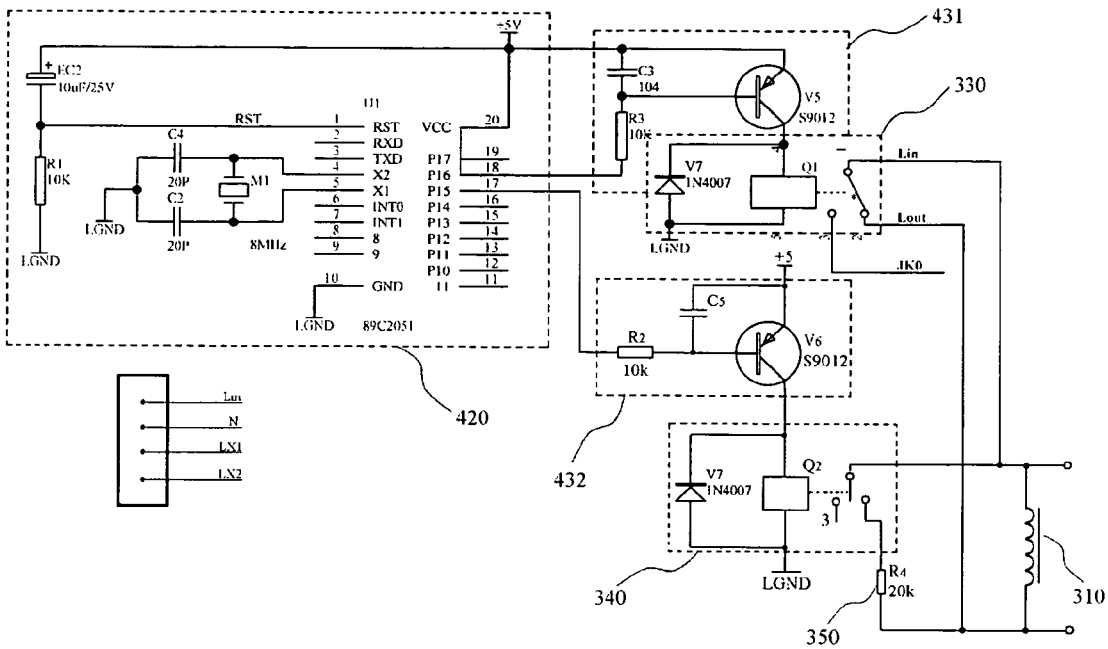

FIG. 5*a* and 5*b* illustrate a detailed circuit diagram of the energy conserving device as shown in FIG. 4. As shown in FIG. 5*a*, the power module 100 supplies 220V AC current, after passing through the transformer 411, the output becomes 7.5V AC current. This is fed in to a full wave rectifier 412 and a chip controlled regulator 413 and produces 5V DC current to the single chip machine (SCM), e.g., the SCM89C2051 as shown in FIG. 5*b*. The SCM89C2051 provides function of a timer. Taken street lights as an example, between 6:00 pm-12:00 am time period, traffic is heavy and road conditions are fairly complicated, which requires a bright illumination. However between 12:00 am-6:00 am, traffic flow is reduced, the road condition improves, and the light intensity can be reduced. Therefore, starting from 6:00 pm, the street lights turn on, and pins 17 and 18 on SCM are high, so as to trigger the switches 330 and 340 (in this embodiment they are relays Q1 and Q2 powered by 5V DC from the regulator 413 as shown in FIG. 5*a*). In this way, the ballast 310 and resistor 350 are short circuited, and the capacitor 320 is disconnected. The street lights work at full capacity under this circuit configuration. When the SCM timer counts to 12:00 am, its 18th pin will change form high to low. The signal passing through a triode S9012 has been amplified to trigger relay Q1, in order to activate the resistor 350, ballast 310 and capacitor 320. After delay of 5 seconds SCM will change output of the pin 17 from high to low as well, the signal will again has been amplified to trigger relay Q2, thereby disconnecting the resistor 350. This will result in a reduced voltage level at the two terminals of the module 240, thus reducing the power output and conserving the energy.

It is well understood by those skilled in the art, that the control mechanism of this energy conserving device is not limited to the manually-controlling, timing-controlling or SCM-controlling mechanism as mentioned in the above embodiments. Other options like a remote-controlling mechanism may be used according to the practical requirements.

Figure 6:
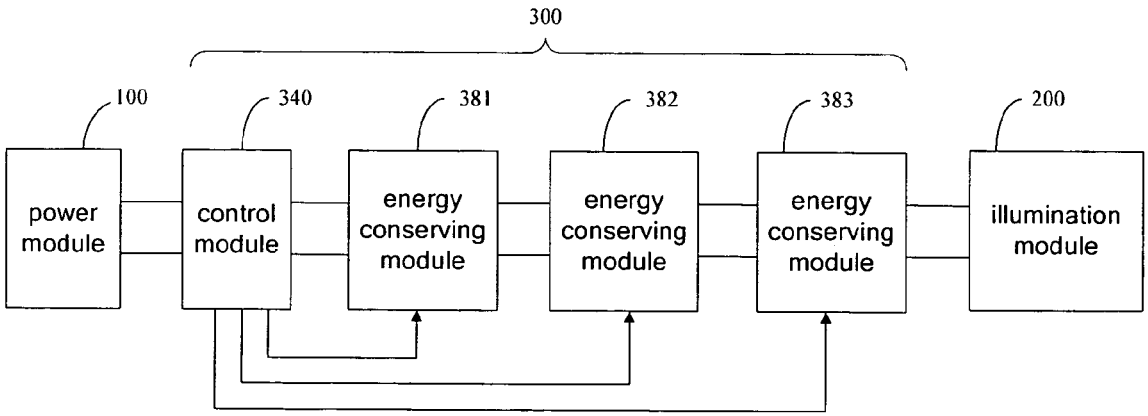
FIG. 6 illustrates a schematic diagram of an energy conserving device with capability for multiple operation modes.

Sometimes, there is a need for an illumination system to work at multiple modes having various intensities of illumination. As to street lights, since traffic is the heaviest between 6:00 pm-12:00 am, the illumination requires maximum intensity—a full mode. The traffic is light between 12:00 am-4:00 am, so less intensity of illumination is needed—a reduced mode. During 4:00 am-6:00 am, traffic begins to pick up, the illumination intensity should be enhanced above the less intensity but weaker than the full mode-an enhance mode. To this end, FIG. 6 shows an energy conserving device 500 with capability for multiple operation modes. As illustrated in the FIG. 6, the energy conserving device 500 includes serially-connected energy conserving modules 301, 302 and 303, each of which is connected to the control module 400, respectively. With this configuration, it is possible to achieve multiple outputs, e.g. 4 outputs. In detail, where energy conserving modules 301, 302, and 303 are all inactive, 100% power will be output. The energy conserving modules 301 and 302 are controlled to be in an inactive state while the module 303 works to reduce the energy output by 20%. The energy conserving module 301 is inactive while both the modules 302 and 303 are active, this will reduce power output by 35%. The energy conserving module 301, 302, and 303 all are active, and the power output will be reduced by 50%.

The energy conserving device according to the present invention can be implemented without changing the circuitry layout of the existing illumination system. This energy conserving device is not only suitable for a new system, but also used as a modification of the existing illumination system. Moreover, this device can not only provide a stable light when needed, but also extend the life of the illumination system. In addition, the device of the invention is cost effective, safe and easy to install.

It will be understood that the device of the present invention can be integrated into one single component so as to be added to the existing illumination system. For example, the device can be installed at the root of a light pole.

Furthermore, the energy conserving device of the invention is of a less demand on the switch hence lowering the failure rate thereof. The ballast usually is inactive, even when it is active, the impact on the grid is minor. Also when operated at a reduced voltage level, the switch can atomically set the system back to an appropriate operation mode avoiding a flickering course by power fluctuation.

The present invention is not limited to the embodiments disclosed herein. Various modifications and variations to the invention will become apparent to those skilled in the art, and such modifications and variations will fall within the scope of the invention as defined in the appended claims.

The invention claimed is:

1. An energy-conserving device for an illumination system, the energy-conserving device being connected between a power supply and a lighting assembly of the illumination system and comprising an energy-conserving assembly, the energy-conserving assembly comprising:

a first switch having a first terminal, a second terminal and a third terminal, the first terminal being configured to be connected to the second terminal or the third terminal;

an inductor, having two terminals respectively connected to the power supply and the lighting assembly, and said two terminals further being connected to the first terminal and the second terminal of the first switch, respectively; and a compensating capacitor, one terminal of which is connected to the power supply, and the other terminal is connected to the third terminal of the switch.

2. The energy-conserving device of claim 1, wherein the energy-conserving device further comprises a second switch and a resistor serially connected to the second switch which are connected in parallel with the inductor.

3. The energy-conserving device of claim 2, wherein the energy-conserving device further comprises a control assembly configured to control the connection and disconnection of the first and second switches, and the control assembly is connected between the power supply assembly and the energy-conserving assembly.

4. The energy-conserving device of claim 3, wherein the control assembly comprises a timing circuit providing switch signals to the first switch and the second switch respectively, and a power circuit which provides a power source to the timing circuit.

5. The energy-conserving device of claim 4, wherein the control assembly further comprises a power driving circuit for amplifying the switch signals, which is connected between the timing circuit and the first and second switches.

6. The energy-conserving device of claim 3, wherein the control assembly is a assembly of timing type, manual type, remote control type, or light type.

7. The energy-conserving device of claim 6, wherein the control assembly of the timing type is a single chip assembly or an RC assembly.

8. The energy-conserving device of claim 2, wherein each of the first and second switches is a relay.

9. The energy-conserving device of claim 2, wherein the energy-conserving device comprises a plurality of energy-conserving assemblies connected in series to each other.

10. The energy-conserving device of claim 9, wherein the energy-conserving device further comprises a control assembly to respectively control the connection and disconnection of the first and second switches in each of the plurality of energy-conserving assemblies, and the control assembly is connected between the power supply assembly and the plurality of energy-conserving assemblies.

* * * * *